US011365949B2

(12) United States Patent
Carlston

(10) Patent No.: US 11,365,949 B2
(45) Date of Patent: Jun. 21, 2022

(54) SAFETY ARCHERY GLOVE

(71) Applicant: Shooting Edge Technology, LLC, Lehi, UT (US)

(72) Inventor: Marvin Carlston, Lehi, UT (US)

(73) Assignee: Shooting Edge Technology, LLC, Lehi, UT (US)

( * ) Notice: Subject to any disclaimer, the term of this patent is extended or adjusted under 35 U.S.C. 154(b) by 0 days.

(21) Appl. No.: 15/864,477

(22) Filed: Jan. 8, 2018

(65) Prior Publication Data

US 2019/0011216 A1 Jan. 10, 2019

Related U.S. Application Data

(60) Provisional application No. 62/444,130, filed on Jan. 9, 2017.

(51) Int. Cl.
*F41B 5/14* (2006.01)
*A63B 71/14* (2006.01)

(52) U.S. Cl.
CPC ..... *F41B 5/1473* (2013.01); *A63B 71/141* (2013.01); *A63B 2209/00* (2013.01); *A63B 2209/023* (2013.01); *A63B 2244/04* (2013.01)

(58) Field of Classification Search
CPC . F41B 5/1473; A63B 71/141; A63B 2244/04; A63B 2209/023
USPC ..... 2/167
See application file for complete search history.

(56) References Cited

U.S. PATENT DOCUMENTS 2,555,203 A * 5/1951 Ramsey ..... F41B 5/1473 124/23.1
2,907,047 A 10/1959 Steinberg
4,326,706 A * 4/1982 Guthrie ..... A63B 21/065 2/160
4,701,963 A 10/1987 Overton
4,958,384 A 9/1990 McCrane
5,070,856 A * 12/1991 Plummer ..... F41B 5/14 124/23.1
5,581,809 A 12/1996 Mah
5,829,057 A * 11/1998 Gunn ..... A41B 11/00 2/69
6,055,669 A * 5/2000 Albert ..... A63B 71/148 2/161.1
6,189,150 B1 * 2/2001 Jones-Roberson ..... A41D 19/01529 2/159

(Continued)

*Primary Examiner* — Richale L Quinn
(74) *Attorney, Agent, or Firm* — Thorpe North & Western, LLP

(57) ABSTRACT

A safety archery glove is disclosed having a first flexible material disposed about a portion of the palm and a portion of the back of the glove, wherein the first flexible material has first coefficient of friction. A second semi-rigid material is disposed about a back side of the glove over the metacarpal region covering at least the first and second metacarpal area of the glove, wherein the second semi-rigid material has a second coefficient of friction. A third flexible material is disposed about the palm and underside of finger sections of the glove, said third flexible material having a third coefficient of friction, wherein the third coefficient of friction is less than the coefficient of friction of the first and second materials. The second semi-rigid material forms a back having at least four lateral sides disposed about a back side of the glove and is coupled to the first flexible material about three sides of the back cover.

14 Claims, 3 Drawing Sheets

(56) References Cited

U.S. PATENT DOCUMENTS

| | | | | |
|---|---|---|---|---|
| 6,341,376 | B1 * | 1/2002 | Smerdon, Jr. | A41D 13/082 128/879 |
| 6,427,248 | B1 * | 8/2002 | Albert | A41D 19/01558 2/161.1 |
| 6,810,531 | B1 * | 11/2004 | Lento | G10D 13/003 2/159 |
| 6,895,598 | B1 * | 5/2005 | Sokolowski | A41D 19/01523 2/159 |
| 8,485,921 | B2 * | 7/2013 | Ramirez | A41D 19/0017 2/161.1 |
| 9,067,123 | B1 * | 6/2015 | Robbins | A63B 71/141 |
| 2003/0188373 | A1 * | 10/2003 | Garneau | A41D 19/01523 2/161.1 |
| 2006/0195968 | A1 * | 9/2006 | Powell | A41D 19/01523 2/161.1 |
| 2007/0028357 | A1 * | 2/2007 | Adams | A63B 21/045 2/163 |
| 2008/0183116 | A1 | 7/2008 | Platt | |
| 2011/0099687 | A1 * | 5/2011 | Skrocki | A41D 19/01523 2/161.1 |
| 2011/0289643 | A1 | 12/2011 | Mazzarolo | |
| 2012/0076985 | A1 * | 3/2012 | Dassler | A41D 19/01523 428/156 |
| 2012/0079640 | A1 * | 4/2012 | Carlston | A63B 71/14 2/2.5 |
| 2014/0189925 | A1 * | 7/2014 | Ramirez | A41D 19/01547 2/16 |
| 2016/0303462 | A1 * | 10/2016 | Ramirez | A63B 71/141 |
| 2018/0192715 | A1 * | 7/2018 | Selbiger | A41D 13/081 |
| 2018/0272225 | A1 * | 9/2018 | Ramirez | A41D 19/0017 |

* cited by examiner

SAFETY ARCHERY GLOVE

PRIORITY

This application claims priority to U.S. Ser. No. 62/444,130 filed on Jan. 9, 2017 entitled "Improved Safety Archery Glove" which is incorporated herein by reference in its entirety.

FIELD OF THE INVENTION

This invention relates generally to the gloves. Specifically, it relates to an improved safety glove used in connection with archery products.

BRIEF DESCRIPTION OF THE FIGURES

To further clarify the above and other aspects of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The drawings are not drawn to scale. The invention will be described and explained with additional specificity and detail through the use of the accompanying drawings in which.

DETAILED DESCRIPTION OF THE ILLUSTRATED EMBODIMENT

Figure 1:
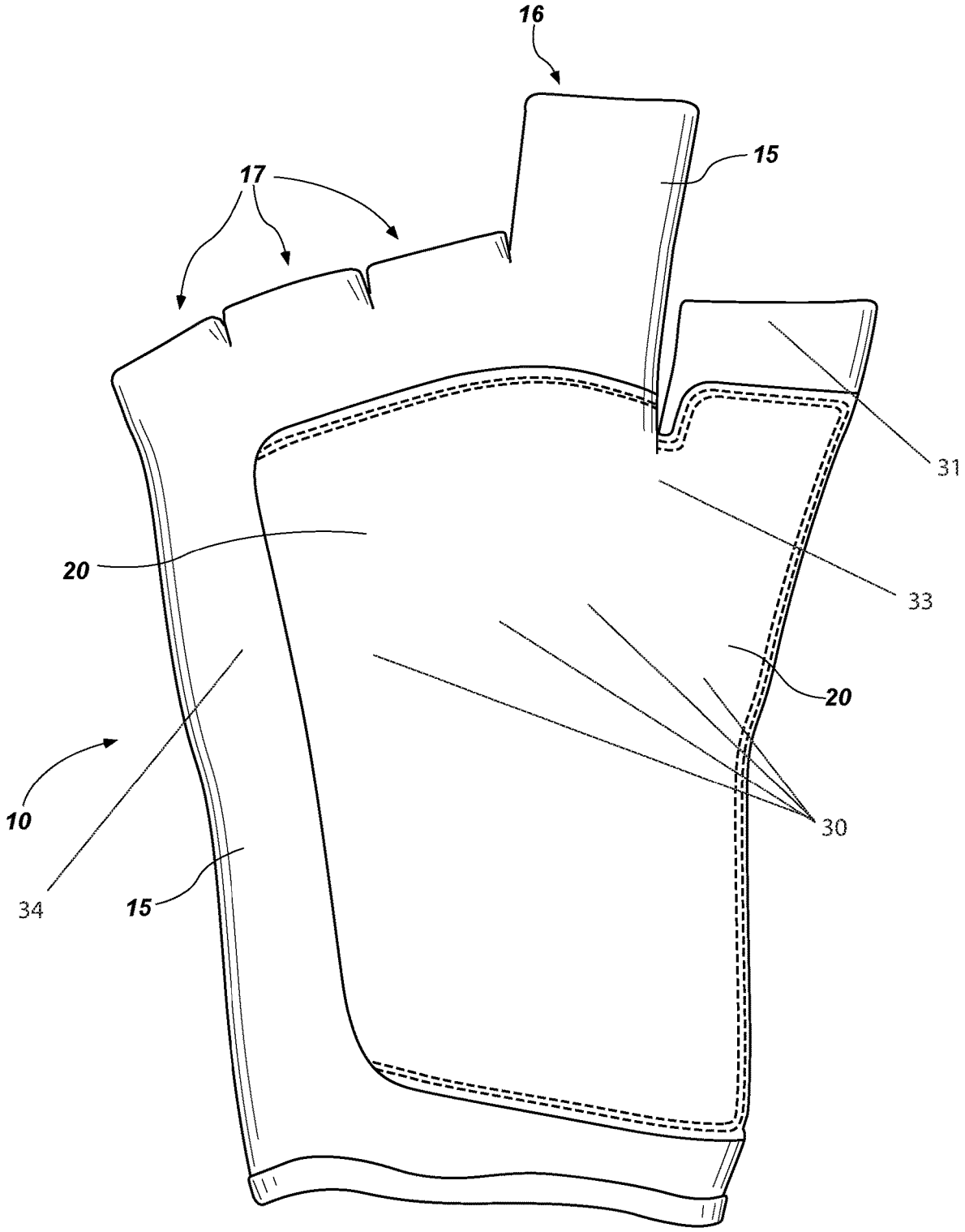
FIG. 1 is a back view of a glove in accordance with one aspect of the technology.

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

The following detailed description and exemplary embodiments of the invention will be best understood by reference to the accompanying drawings, wherein the elements and features of the invention are designated by numerals throughout.

Figure 2:
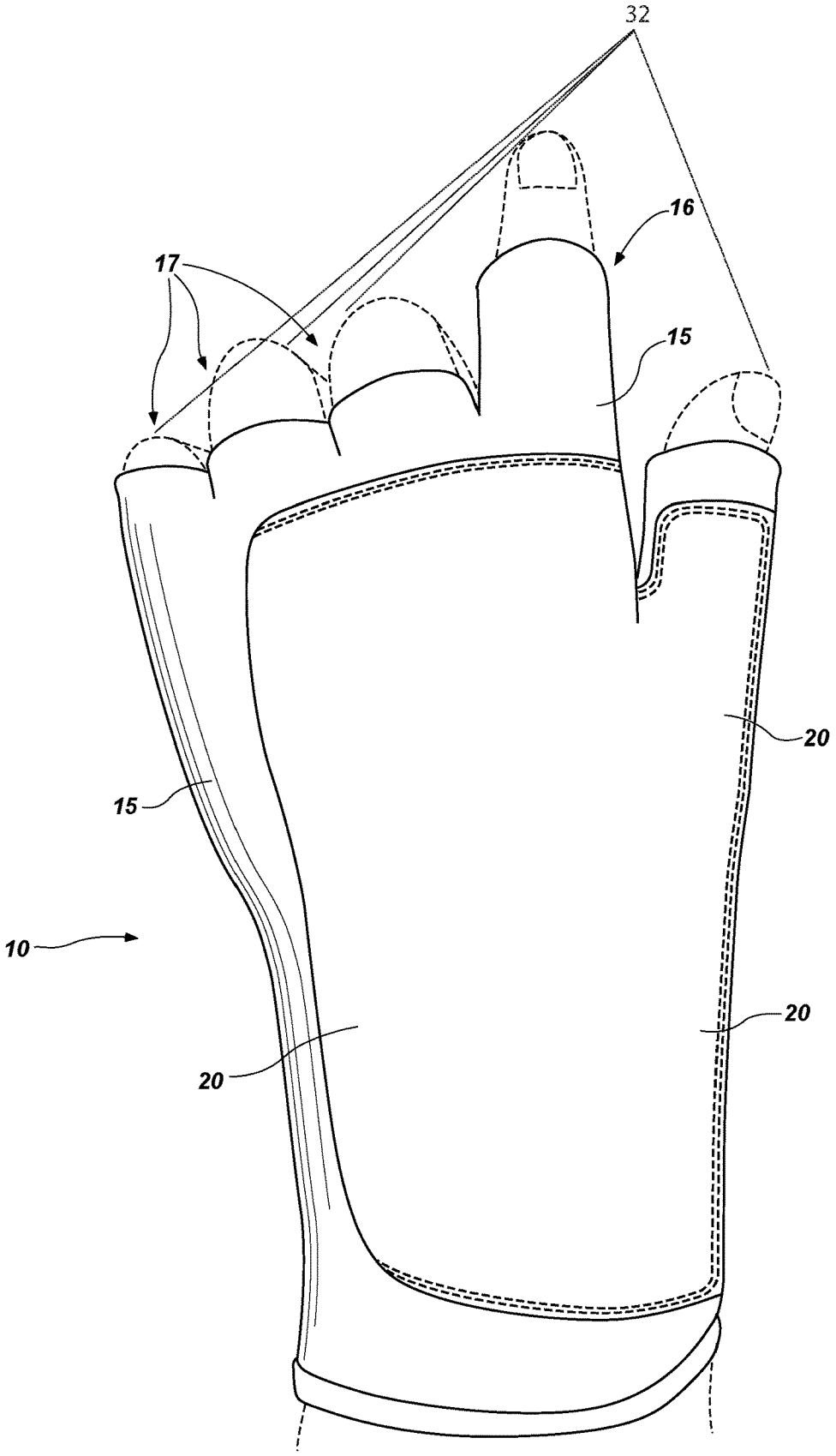
FIG. 2 is a back view of the glove of FIG. 1 with the hand of a user inserted therein.
Figure 3:
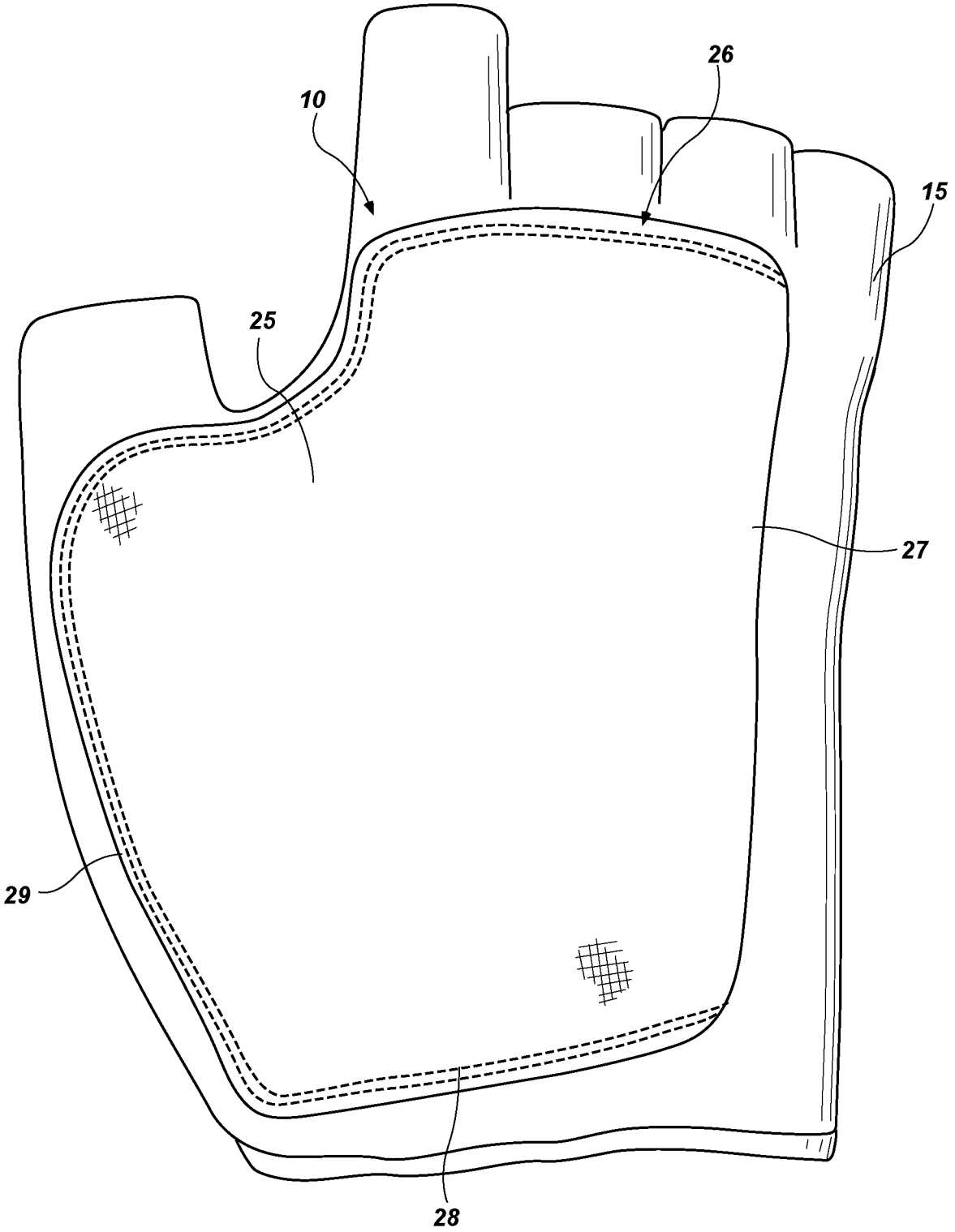
FIG. 3 is a front or palm-side view of a glove in accordance with one aspect of the technology.

The present technology in its various embodiments, some of which are depicted in FIGS. 1-3 herein, can be broadly described as a safety glove for use in archery applications. There are hundreds of injuries per year where the archer, or user, has their hand pierced by a broken arrow shaft, or an arrow that is too short for the bow, for example. These accidents often permanently cripple the archer for life. This accident often occurs because the arrows are made of fiber, fiber glass, or other composite materials, and even metal arrows. Thus, when an arrow is pulled back, in the traditional posture, the shaft of the arrow may become lodged, wedged, jammed or held between the arrow rest on the bow, and the bow riser. If this occurs the bound arrow can buckle and break because of the energy of the drawn bow. Under these circumstances, the arrow can split into dozens of long splinters that are then projected into the back side of the hand holding the bow.

In addition, when the hand of the user grips the bow and begins to draw the bow, the position of the hand on the handle of the bow is "set" in that the three-dimensional orientation of the hand with respect to the handle of the bow does not change due to the pressure between the hand and the handle of the bow while the bowstring is drawn and the friction between the hand of the user and the handle of the bow. If the hand of the user is not pre-positioned in state to optimize the line of sight between the bow and the user as well as proper angular alignment of the hand, wrist, and arm of the user, accuracy of the user is decreased which can also increase the chance of a broken arrow that lodges in the hand of the user. Moreover, in some instances, because the hands of users may be shaped differently from one another, reinforced portions of a safety glove may fit differently on different portions of different-shaped hands. Aspects of the technology minimize the above-referenced concerns.

In one aspect of the technology, a safety glove 10 is disclosed comprising a first flexible material 15 intended to cover the palm and a portion of the back of the hand (e.g., at least a portion of the metacarpal region of the hand), at least a portion of the fingers (i.e., the phalanges), and a portion of the wrist (i.e., the carpal region of the hand). In one aspect of the technology, the first flexible material 15 comprises cloth, knitted or felted wool, leather, rubber, latex, neoprene, and/or another synthetic material. The first material may cover all or only a portion of these areas depending on the placement of other materials discussed herein.

A second semi-rigid material 20 that is resistant to the force from a broken arrow is disposed about a back side of the glove over the metacarpal region which is intended to extend over the first through the fourth metacarpals (i.e., the bones in the back of the hand connected to the thumb through the ring finger) though it can extend over fewer or more metacarpals. In one aspect, the second material 20 extends to at least the first knuckle of the first through the fourth phalanges (i.e., the thumb through the ring finger). Importantly, the second material 20 extends over the purlicue of the hand (i.e., the flesh of the hand between the thumb and index finger of the hand). The second material 20 can be comprised of Kevlar (poly-para-phenylene terephthalamide), Lexan, carbon fiber composite materials, aromatic polyamide fibers, and other materials with similar impact resistant characteristics. In one aspect of the technology, the second material has a density ranging from between 0.4 and 0.6 pounds per cubic inch, a breaking strength ranging from between 55 and 80 pounds, breaking tenacity ranging from between 400,000 and 450,000 pounds per square inch, and a tensile modulus ranging from between 60,000 and 120,000 MPa.

In one aspect of the technology, the second material 20 is joined to the first material 15 through stitching about the perimeter of the second material 20. However, joining different materials of the glove portions, so they can remain joined, may include interior sewing, exterior sewing, exterior chain sewing, interior chain sewing, meshing, hand-made exterior glove sewing, hand-made interior glove sewing, zigzag sewing, gluing, bonding, or other known methods. In one aspect, at least one side of the second material 20 is not joined to the first material. That is, the second material 20 generally has four sides and at least one of the four sides is not joined to the first material 15. In one aspect, the side of the second material 20 that is opposite the thumb of the glove 10 (i.e., the side nearest the fourth or fifth metacarpal 34) is not joined to the first material 15. Advantageously, when the hand of the user is inserted into the glove 10, if the hand of the user is not shaped to fit exactly within the dimensions of the glove 10, the first flexible material 15 can stretch to accommodate the hand without repositioning the semi-rigid second material 20 about the top of the hand. In this manner, placement of the second material 20 about the first and second metacarpals and purlicue is optimized maximizing the protective capabilities of the glove 10 over the area most likely to be struck by an errant arrow.

In accordance with one aspect of the technology, a third flexible material 25 is placed about the palm and/or the underside of portions of the finger sections of the glove 10. The third flexible material 25 has a low coefficient of friction when compared to the first and second materials. In one aspect of the technology, the third flexible material 25 is intended to cover all portions of the glove that will be in contact with the handle of the bow when the user grips the bow. However, in one aspect of the technology the third material 25 only covers portions of the glove that are in contact with the handle of the bow. The third material 25 may comprise spandex, PTFE and secondary fiber sateen weave fabrics treated with thermosetting resins, fiber flock face composites manufactured from plain weave fabrics treated with thermosetting resins reinforced with PTFE fiber flock particles, silicone coated cloth, polymeric materials such as olefin polymers, and other low friction materials, including materials sold under the brand GLIDER® and/or GLIDEWEAR®. In one aspect of the technology, the third material comprises a coefficient of friction ranging from about 0.2 to 0.3. In another aspect, the third material 25 comprises a coefficient of friction ranging from about 0.25 to 0.5.

Advantageously, the third material allows the hand of the glove to grip the handle of the bow, but still reposition the hand once pressure is applied to the bow string. In this manner, the position of the hand and wrist with respect to the arm can be adjusted when the bow string is drawn in order to optimize accuracy of the shot and minimize the likelihood of injury. Similar to the second material 20, the third material 25 is joined to the first material through stitching or other known means. Likewise, in one aspect of the technology, one side of the third material 25 is not joined to the first material 15 in order to allow for expansion of the first material 15 to accommodate different hand sizes in the same glove while maximizing proper placement of the low friction material about the bottom of the glove.

In another aspect of the technology, the safety glove 10 is disclosed comprising a first material 15 configured to cover the palm, wrist, and back of the hand of a user. The first, third, fourth and fifth fingers 32 of the glove are truncated though the index finger (i.e., the second phalange) 16 of the glove having a length that is longer than the remaining fingers 17 of the glove 10. A second material 20 is coupled to the back of the first material 15 and extends over the first through the forth metacarpals of the glove, the wrist of the glove, and over the first knuckles of the first through fourth phalanges of the glove 10. A third material 25 is joined to a bottom of the glove 10. The third material is joined however, on the three different sides of the glove at 26, 28, and 29. The fourth side 27 is not stitched to allow for expansion of the glove without movement of the third material to accommodate the expansion. The second material 20 comprises an impact-resistant material as referenced above and the third material 25 comprises a low friction material.

The invention claimed is:

1. An archery glove, comprising:

a first material that is flexible disposed about a portion of a palm of the glove and a portion of a back of the glove, wherein the first material has a first coefficient of friction;

a second material that comprises a degree of rigidity disposed about at least part of the portion of the back of the glove, adapted to extend over the metacarpal region, covering at least first and second metacarpal areas of the glove, wherein the second material has a second coefficient of friction; and a third material that is flexible disposed about the palm of the glove and a portion of the glove below a finger section of the glove, said third material having a third coefficient of friction, wherein the third coefficient of friction is less than each of the first and second coefficients of friction;

wherein third, fourth, and fifth fingers of the finger section of the glove are truncated near a first knuckle of the glove, and a second finger of the finger section of the glove is truncated at a second knuckle of the glove above the first knuckle of the glove.

2. The archery glove of claim 1, wherein the second material extends over third and fourth metacarpal areas of the glove.

3. The archery glove of claim 1, wherein the first material is at least one material selected from the group of materials consisting of cloth, knitted or felted wool, leather, rubber, latex, neoprene, and metal.

4. The archery glove of claim 1, wherein the second material comprises poly-para-phenylene terephthalamide.

5. The archery glove of claim 1, wherein the third material comprises spandex or Polytetrafluoroethylene (PTFE).

6. An archery glove, comprising:

a first material that is flexible disposed about a portion of a palm of the glove and a portion of a back of the glove;

a second material that comprises a degree of rigidity forming a back cover, said back cover having at least four sides disposed about at least part of the portion of the back of the glove, adapted to extend over the metacarpal region, said back cover covering at least a purlicue area of the glove, wherein the second material is coupled to the first material about three sides of the back cover; and a third material that is flexible forming a front cover, said front cover disposed about the palm of the glove and a portion of the glove below a finger section of the glove, wherein said front cover is coupled to the first material about three sides of the front cover;

wherein at least a portion of a fourth side of the front cover is not coupled to the first material or the second material.

7. The glove of claim 6, wherein the three sides of the front cover coupled to the first material are a top side, a bottom side and a side nearest a first metacarpal area of the glove.

8. The glove of claim 7, wherein the front cover is not coupled to the first material about at least a portion of the side of the front cover nearest a fifth metacarpal area of the glove.

9. The glove of claim 6, wherein at least a portion of a fourth side of the back cover is not coupled to either the first material or the third material.

10. The glove of claim 9, wherein the back cover is coupled to the first material at a top side, a bottom side and a first metacarpal area of the glove.

11. The glove of claim 10, wherein the back cover is not coupled to the first material about at least a portion of the side of the front cover nearest a fifth metacarpal area of the glove.

12. An archery glove, comprising:

a first material that is flexible disposed about a portion of a palm of the glove and a portion of a back of the glove, wherein the first material has first coefficient of friction;

a second material that comprises a degree of rigidity disposed about at least part of the portion of the back of the glove, adapted to extend over the metacarpal region, covering at least first and second metacarpal areas of the glove, wherein the second material has a second coefficient of friction;

a third material that is flexible disposed about the palm of the glove and a portion of the glove below a finger section of the glove, said third material having a third coefficient of friction, wherein the third coefficient of friction is less than each of the first and second coefficients of friction;

wherein the second material forms a back cover having at least four sides disposed about the back of the glove, wherein the second material is coupled to the first material about three sides of the back cover and wherein the third material forms a front cover coupled to the first material about three sides of the front cover and at least a portion of a fourth side of the front cover is not coupled to the first material or the second material.

13. The archery glove of claim 12, wherein the third material extends over at least a first, second, third and fourth metacarpal areas of the glove.

14. The archery glove of claim 12, wherein the second material comprises a material capable of resisting impact.

* * * * *